US011235488B2

(12) United States Patent
Lim

(10) Patent No.: US 11,235,488 B2
(45) Date of Patent: Feb. 1, 2022

(54) DIEBOARD PADDING

(71) Applicant: Seoul Laser Dieboard System Co., Ltd., San Diego, CA (US)

(72) Inventor: Kyong Chan Lim, San Diego, CA (US)

(73) Assignee: Seoul Laser Dieboard System Co., Ltd., San Diego, CA (US)

( * ) Notice: Subject to any disclaimer, the term of this patent is extended or adjusted under 35 U.S.C. 154(b) by 0 days.

(21) Appl. No.: 15/904,073

(22) Filed: Feb. 23, 2018

(65) Prior Publication Data

US 2018/0236683 A1 Aug. 23, 2018

Related U.S. Application Data

(60) Provisional application No. 62/462,545, filed on Feb. 23, 2017.

(51) Int. Cl.

| | |
|---|---|
| ***B26F 1/44*** | (2006.01) |
| ***B26F 1/40*** | (2006.01) |
| ***B21D 37/20*** | (2006.01) |
| ***B30B 15/02*** | (2006.01) |
| ***B31B 50/14*** | (2017.01) |
| ***B31B 50/25*** | (2017.01) |
| ***B26D 7/18*** | (2006.01) |
| *B31B 110/35* | (2017.01) |
| *B31B 100/00* | (2017.01) |

(52) U.S. Cl.

CPC ..... *B26F 1/44* (2013.01); *B21D 37/205* (2013.01); *B26D 7/1818* (2013.01); *B26F 1/40* (2013.01); *B30B 15/02* (2013.01); *B31B 50/14* (2017.08); *B31B 50/142* (2017.08); *B31B 50/252* (2017.08); *B26F 2001/4463* (2013.01); *B31B 2100/0022* (2017.08); *B31B 2110/35* (2017.08)

(58) Field of Classification Search

CPC ..... B26F 1/44; B26F 1/40; B26F 2001/4463; B26F 2001/4481; B31B 50/14; B31B 50/142; B31B 50/252; B30B 15/02; B21D 37/205; B21B 211/35; Y10S 83/954; Y10T 83/8831; Y10T 83/9454; Y10T 83/19447; Y10T 83/9449; Y10T 83/9408; Y10T 83/0524; Y10T 83/04; Y10T 83/8821

USPC ..... 83/13, 55, 689.697, 689, 595, 658, 660, 83/835, 620, 694, 698.11, 699.51, 954, 83/698.71, 699.11, 39, 678, 613, 669, 83/171, 16, 123, 11, 12; 29/525.11, 29/401.1, 525.01; 76/107, 107.8

See application file for complete search history.

(56) References Cited

U.S. PATENT DOCUMENTS 1,670,898 A * 5/1928 Messmer, Jr. ..... C14B 5/02 83/128

3,154,664 A * 10/1964 Zeder, Jr. ..... B21D 37/205 219/69.1

(Continued)

*Primary Examiner* — Ghassem Alie

(74) *Attorney, Agent, or Firm* — Procopio, Cory, Hargreaves & Savitch LLP

(57) ABSTRACT

Applying padding material around shaped cutting blades includes: receiving a blade shape diagram and a rule of blade; bending the rule of blade according to the blade shape diagram to produce the shaped cutting blades; and applying the padding material around the shaped cutting blades using the blade shape diagram to produce a padded shaped cutting blade, wherein the padding material provides a spring action to quickly detach the shaped cutting blades from a plate matter.

5 Claims, 10 Drawing Sheets

(56) References Cited

U.S. PATENT DOCUMENTS

| | | | | | |
|---|---|---|---|---|---|
| 3,587,377 | A * | 6/1971 | Olsen et al. | B26D 7/10 | 83/171 |
| 3,737,365 | A * | 6/1973 | Smith | B26F 1/44 | 428/67 |
| 3,774,281 | A * | 11/1973 | Eliason | B21C 37/09 | 29/890.14 |
| 4,543,862 | A * | 10/1985 | Levene | B26F 1/40 | 269/21 |
| 4,672,870 | A * | 6/1987 | Levene | B26F 1/40 | 269/21 |
| 5,537,895 | A * | 7/1996 | Young | B21D 7/06 | 72/166 |
| 8,042,440 | B2 * | 10/2011 | Osumi | B26F 1/44 | 83/39 |
| 9,309,663 | B2 * | 4/2016 | Fay | E04B 1/74 | |
| 2004/0255741 | A1 * | 12/2004 | Deng | B23P 15/406 | 83/13 |
| 2005/0132861 | A1 * | 6/2005 | Deng | B26F 1/44 | 83/684 |
| 2007/0017329 | A1 * | 1/2007 | Osumi | B26F 1/44 | 83/13 |
| 2015/0352741 | A1 * | 12/2015 | Nabity | B26D 1/0006 | 83/698.91 |

* cited by examiner

DIEBOARD PADDING

CROSS-REFERENCE TO RELATED APPLICATIONS

This application claims the benefit of priority under 35 U.S.C. § 119(e) of U.S. Provisional Patent Application No. 62/462,545, filed Feb. 23, 2017, entitled "Dieboard Padding." The disclosure of the above-referenced application is incorporated herein by reference.

BACKGROUND

Technological Field

The present disclosure relates to dieboard padding, and more specifically, to applying padding material around shaped cutting blades.

Background

Generally, a cutting blade is inserted into a pattern board for use in pressing a folding or a cutting line on plate matters such as paper, canvas, leather, plastic, etc. The plate matters with such pressed folding and/or cutting lines (i.e., the pressed lines) can be used in a folded shape like a box (e.g., a pizza box), card (e.g., a greeting card), or other similar items. Accordingly, in order to assemble the plate matter into a predetermined shape with the cutting blade, it is necessary to process and fold the cutting blade into a shape suitable for forming the pressed line.

SUMMARY

This disclosure describes methods and systems for applying padding material around the shaped cutting blades to provide a spring action to quickly detach the blades from a plate matter and to prevent the plate matter from getting stuck on the cutting blades.

In one implementation, a method for applying padding material around shaped cutting blades is disclosed. The method includes: receiving a blade shape diagram and a rule of blade; bending the rule of blade according to the blade shape diagram to produce the shaped cutting blades; and applying the padding material around the shaped cutting blades using the blade shape diagram to produce a padded shaped cutting blade, wherein the padding material provides a spring action to quickly detach the padded shaped cutting blade from a plate matter.

In another implementation, a system for applying padding material around shaped cutting blades is disclosed. The system includes: a bender configured to receive and bend a rule of blade according to a blade shape diagram to produce the shaped cutting blades; and a padding applicator configured to receive the blade shape diagram and apply the padding material around the shaped cutting blades using the blade shape diagram to produce a padded shaped cutting blade, wherein the padding material provides a spring action to quickly detach the padded shaped cutting blade from a plate matter.

Other features and advantages of the present disclosure should be apparent from the following description which illustrates, by way of example, aspects of the disclosure.

BRIEF DESCRIPTION OF THE DRAWINGS

The details of the present disclosure, both as to its structure and operation, may be gleaned in part by study of the accompanying drawings.

DETAILED DESCRIPTION

Figure 1A:
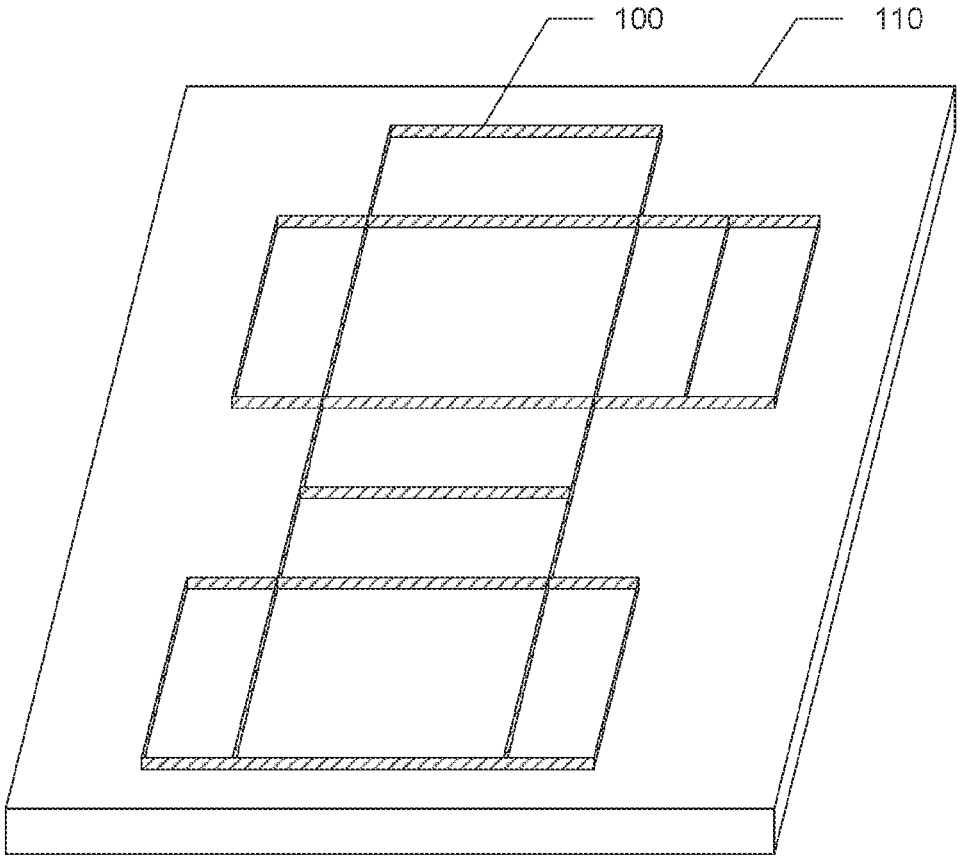
FIG. 1A shows one example of a cutting blade inserted into a pattern board.

The present disclosure describes methods and systems for applying padding material around the shaped cutting blades to provide a spring action to quickly detach the blades from a plate matter and to prevent the plate matter from getting stuck on the cutting blades are described. The detailed description set forth below, in connection with the accompanying drawings, is intended as a description of various implementations and is not intended to represent the only implementations in which the disclosure may be practiced. The detailed description includes specific details for the purpose of providing a thorough understanding of the implementations. In some instances, well-known structures and components are shown in simplified form for brevity of description. As used herein, like reference numerals refer to like features throughout the written description.

FIG. 1A shows one example of a cutting blade 100 inserted into a pattern board 110 (often referred to as a "die-board"). As shown, the cutting blade 100 of FIG. 1 is folded in a shape suitable for forming the pressed line in the predetermined shape. However, prior to folding the cutting blade 100, the cutting blade needs to be processed so that the cutting blade 100 attaches to the pattern board 110 and is able to cut and/or press the plate matter properly.

Figure 1B:
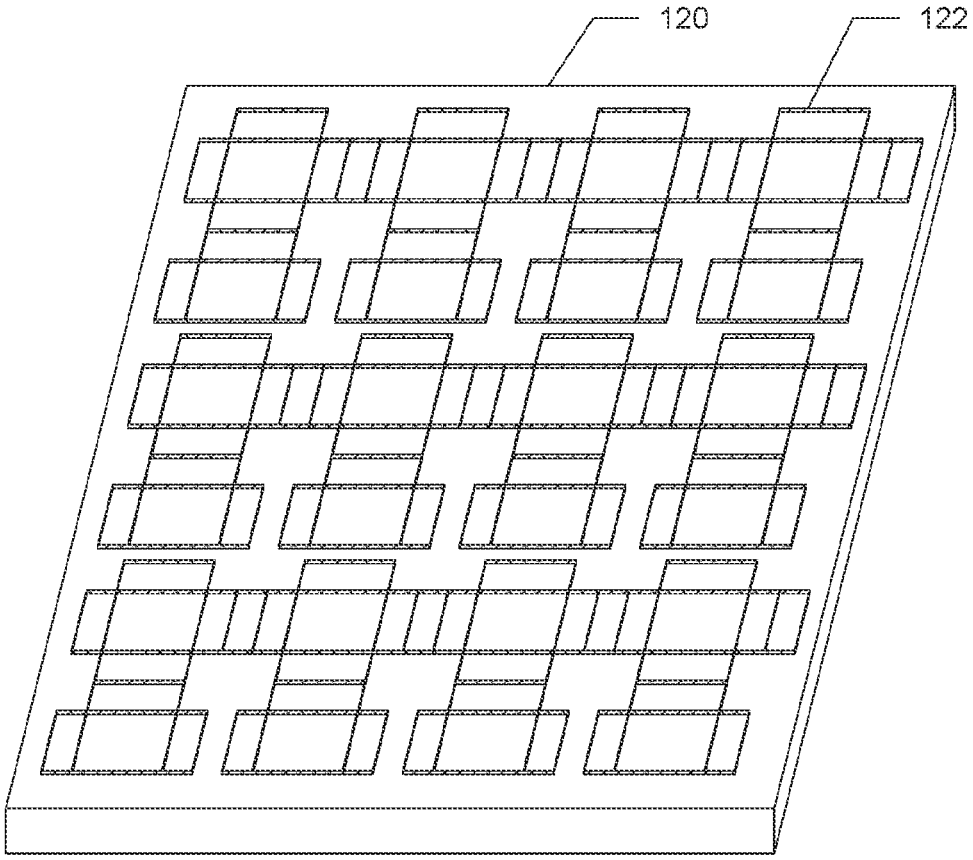
FIG. 1B shows another example pattern with multiple shaped cutting blades inserted into the die-board.

FIG. 1B shows another example pattern with multiple shaped cutting blades 122 inserted into the die-board 120. In FIG. 1B, twelve shaped blades 122 (laid out in three rows by four columns) are inserted into the dieboard 120 so that the single press of the dieboard 120 on the plate matters would produce twelve shapes for folding at once. In other implementations, a different number of shaped blades can be used on a single dieboard.

Figure 1C:
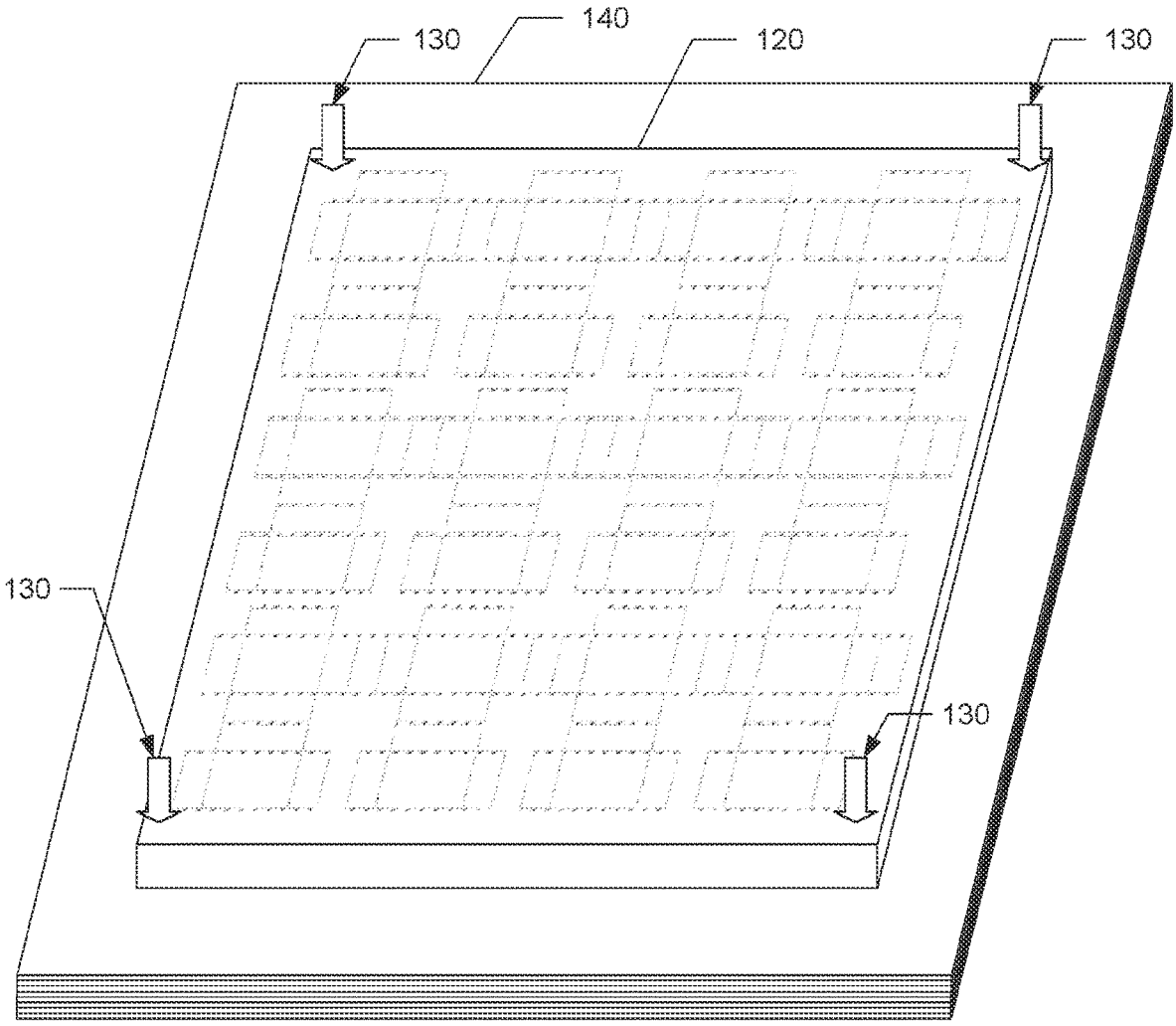
FIG. 1C shows the dieboard turned over and used to press it onto the plate matter to produce shapes to be folded into boxes, cards, etc.

FIG. 1C shows the dieboard 120 turned over and used to press (see movement 130) it onto the plate matter 140 to produce shapes to be folded into boxes, cards, etc. In general, the movement 130 is an automatic press movement made on a machine. However, in practice, when the dieboard 120 is pressed onto a thin sheet of plate matter 140, sometimes the thin sheet gets stuck on the cutting blades and causes the machine to stop the process so that the thin sheet will not tear or get damaged.

Figure 2:
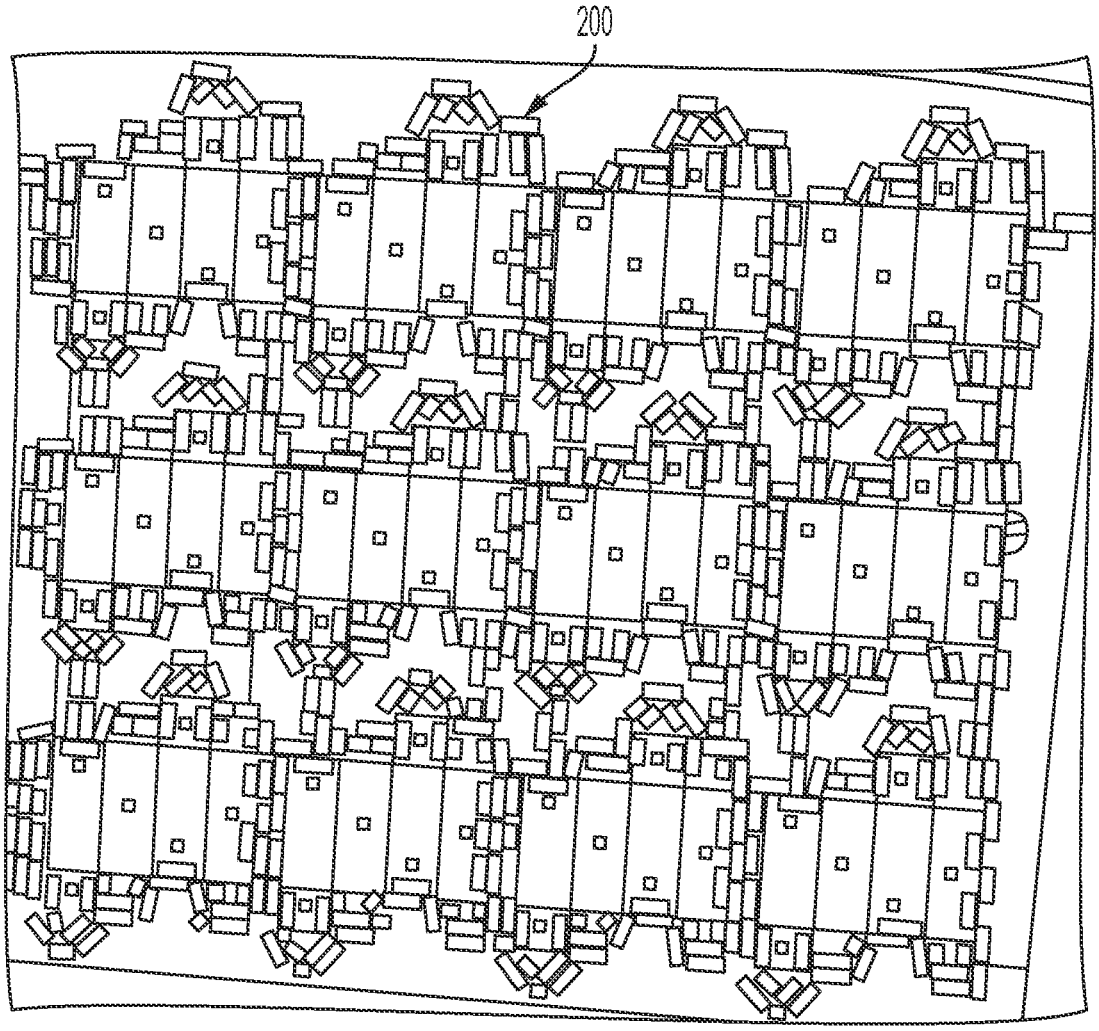
FIG. 2 shows one example of attaching foam pads next to the cutting blades so that when the dieboard is pressed onto the plate matter, the pads provide a spring action to quickly detach the blades from the plate matter to prevent the plate matter from getting stuck on the cutting blades.
Figure 3:
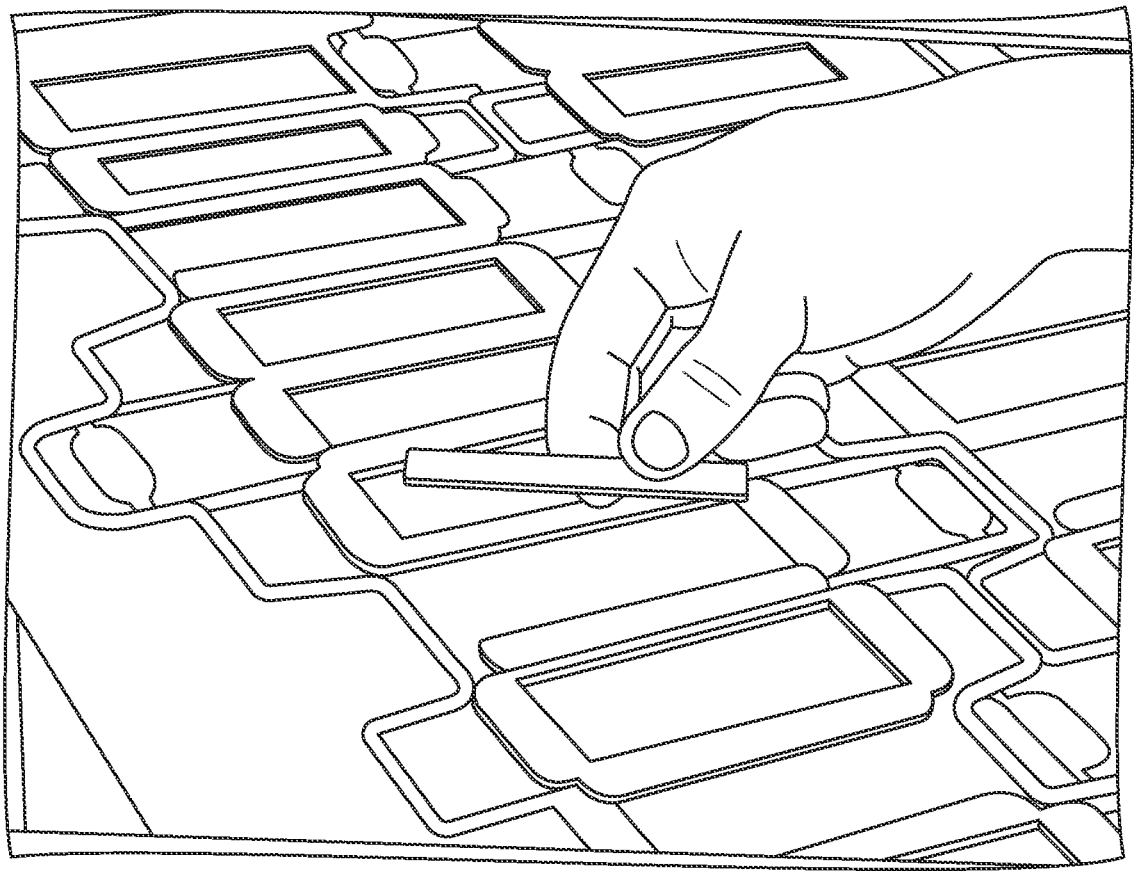
FIG. 3 shows that attaching foam pads to the dieboard can be a laborious manual work.
Figure 4:
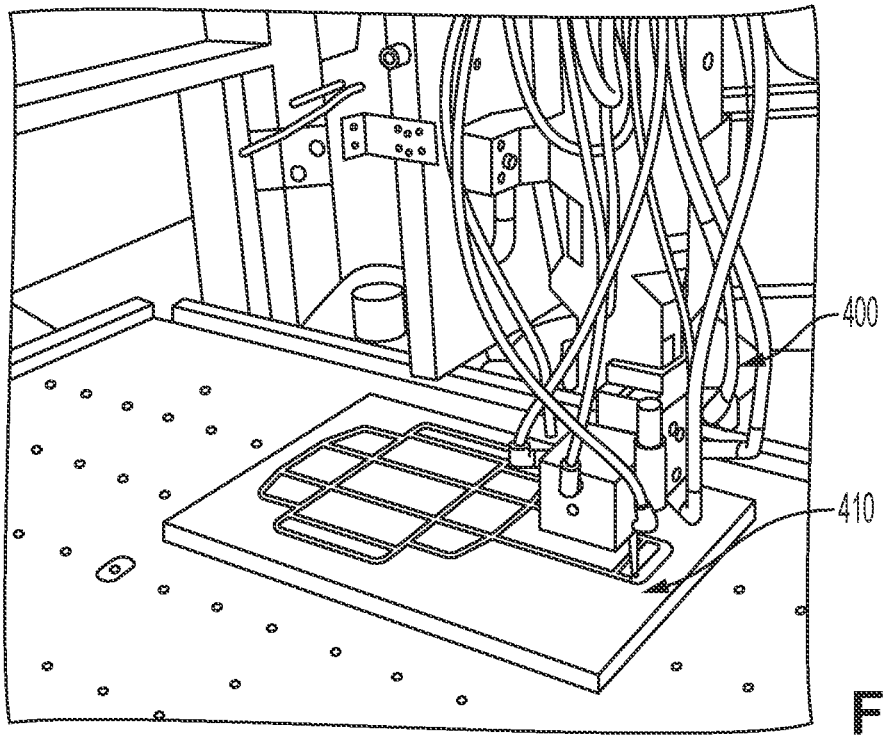
FIGS. 4-7 show the foam padding applied next to the shaped cutting blades so that the padding can provide a spring action.
Figure 5:
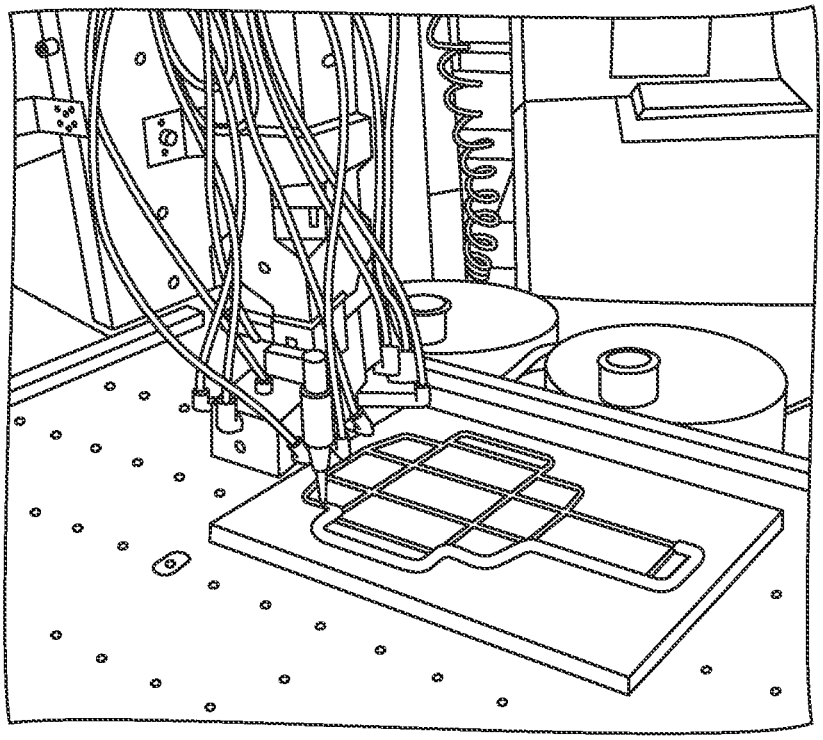
Figure 6:
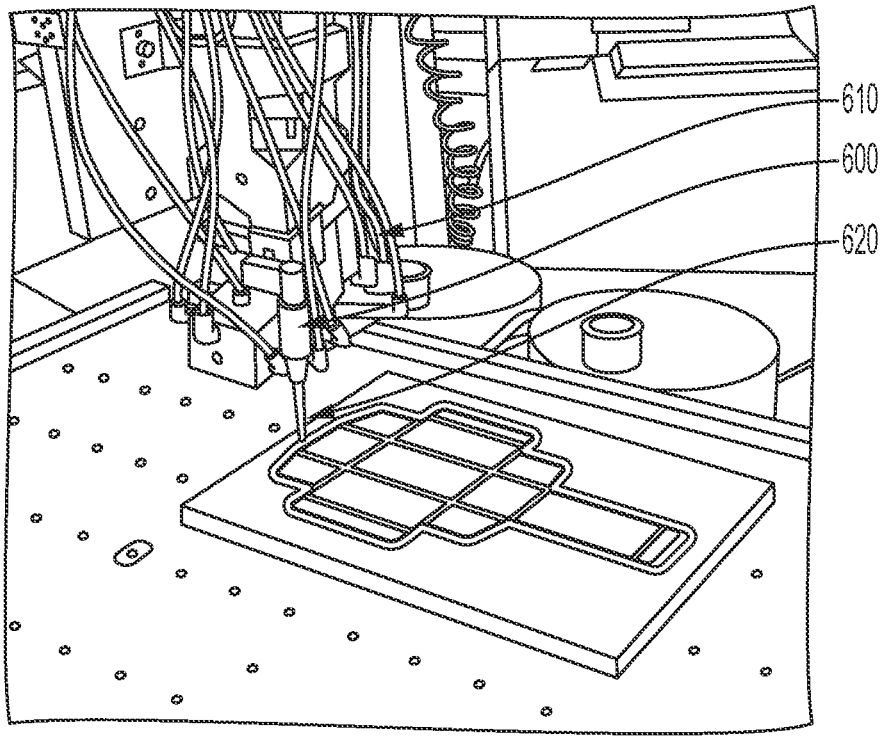
Figure 7:
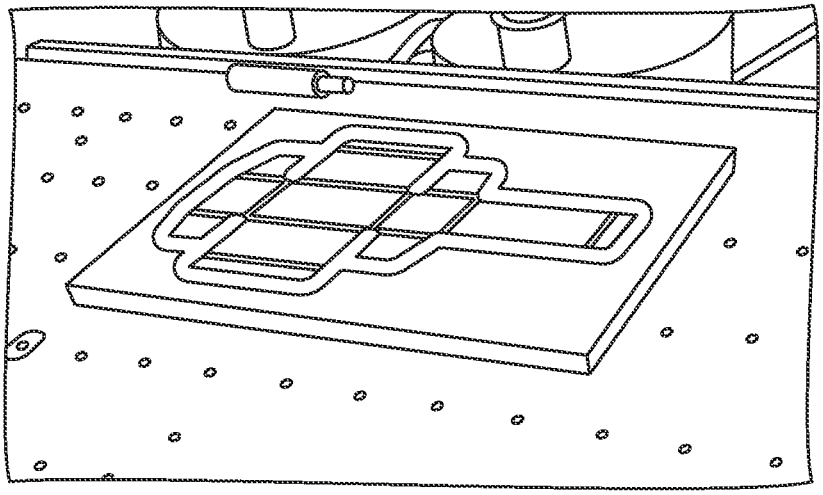

Accordingly, attempts are made to lessen the incidents where the sheet of plate matter gets stuck on the cutting blades. FIG. 2 shows one example of attaching foam pads 200 next to the cutting blades so that when the dieboard is pressed onto the plate matter, the pads provide a spring action to quickly detach the blades (i.e., to quickly move the blade away) from the plate matter to prevent the plate matter from getting stuck on the cutting blades. However, attaching the foam pads 200 to the dieboard can be a laborious manual work as shown in FIG. 3.

FIGS. 4-7 show one example of a process of applying or spraying the foam padding onto a dieboard 410 using a padding applicator 400. As shown in FIGS. 4-7, the foam padding is applied next to the shaped cutting blades by the padding applicator 410 so that the padding can provide a spring action.

Figure 8:
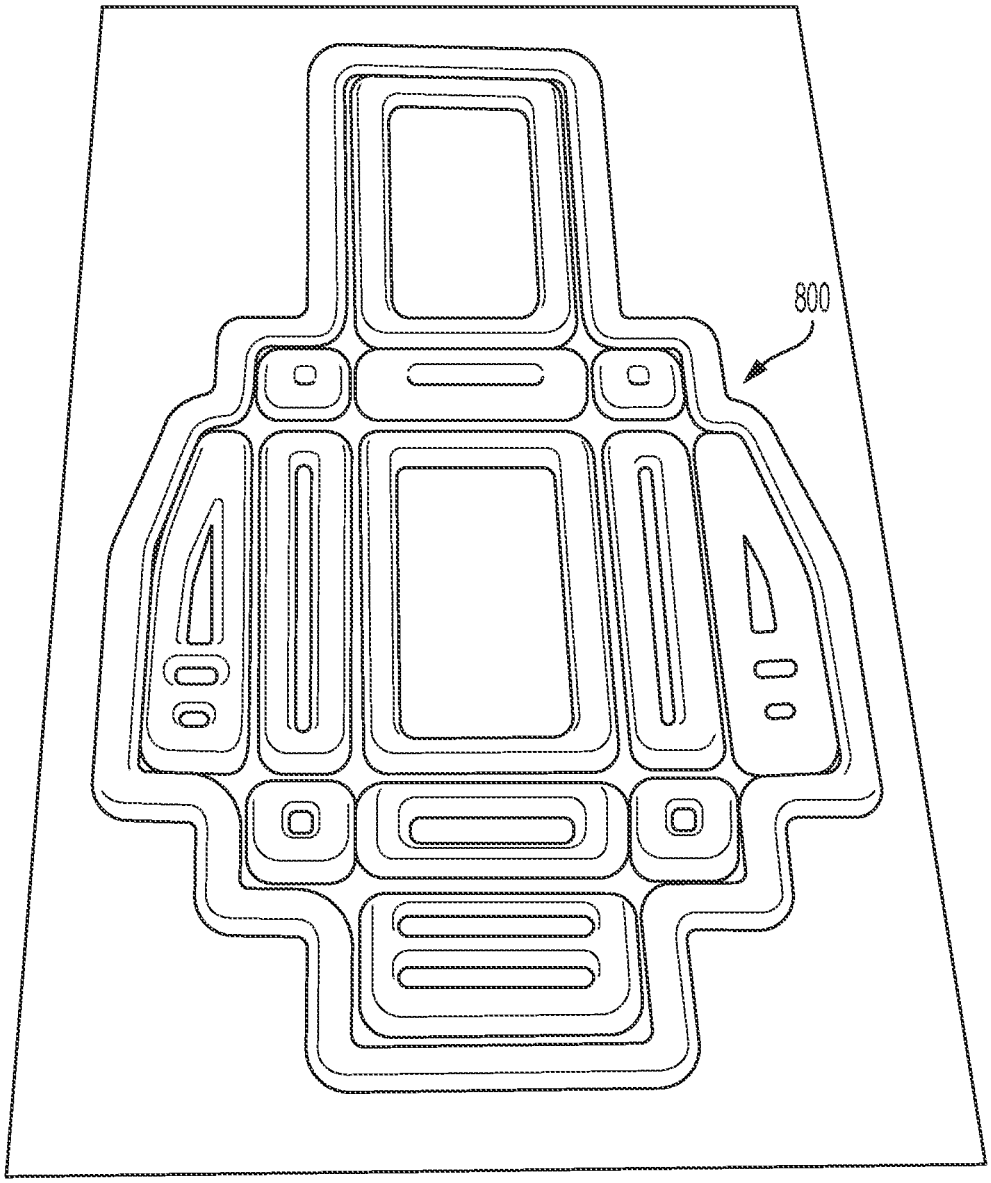
FIG. 8 shows the padded shaped blade in accordance with one implementation.

FIG. 8 shows the padded shaped blade 800 in accordance with one implementation of the present disclosure.

Figure 9:
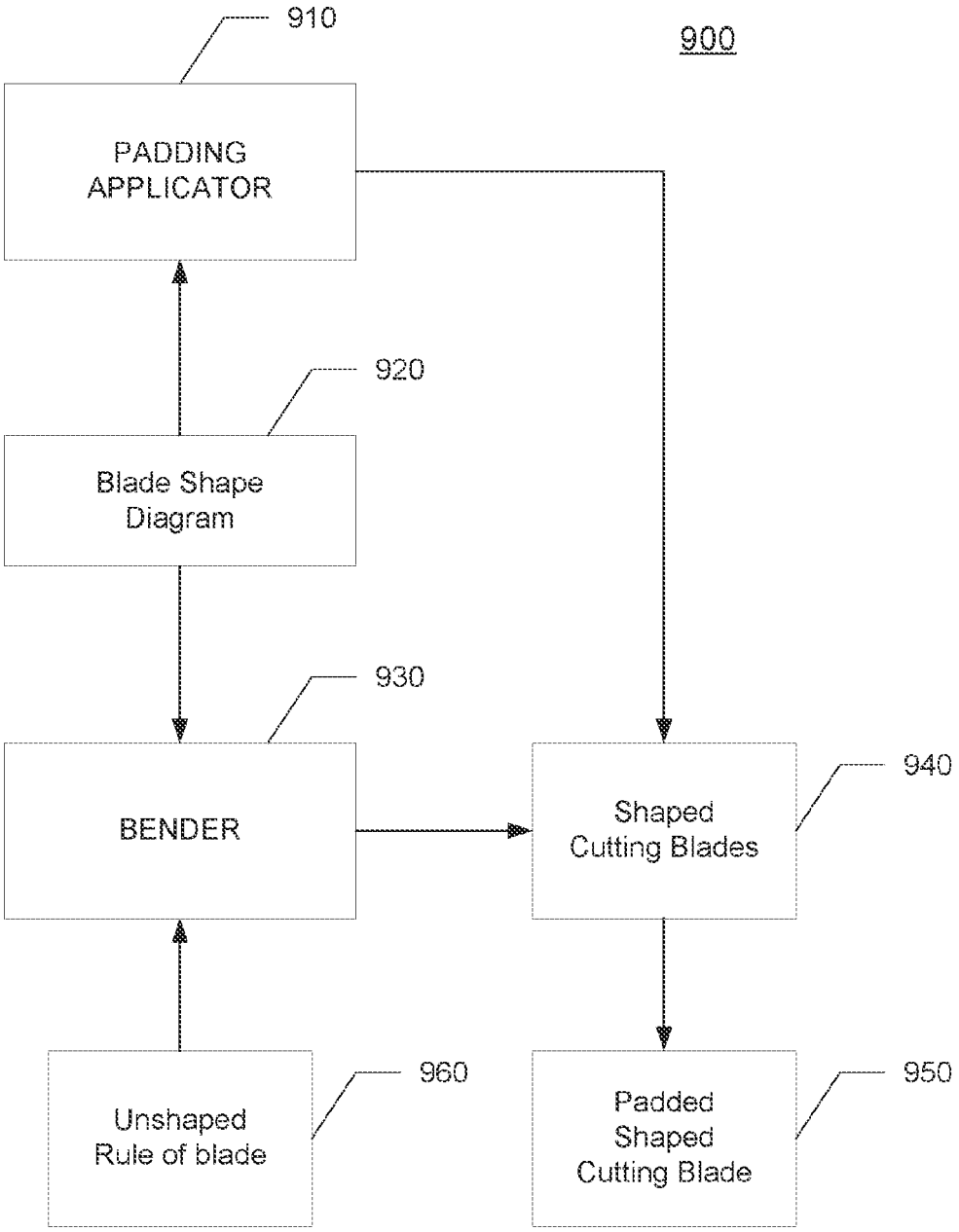
FIG. 9 is a block diagram of a system including the padding applicator in accordance with one implementation of the present disclosure.

FIG. 9 is a block diagram of a system 900 for applying padding material around shaped cutting blades to provide a spring action to quickly detach the padded shaped cutting blade from a plate matter, wherein the system includes the padding applicator 910 in accordance with one implementation of the present disclosure. In the illustrated implementation of FIG. 9, the system 900 also includes a bender 930 which is used to fold a rule of blade 960 into shaped cutting blades 940. To automatically produce the shaped cutting blades 940, the bender 930 also receives a blade shape diagram 920, which is also sent to the padding applicator 910.

The padding applicator 910 receives the same blade shape diagram 920 that was sent to the bender 930 to bend and produce the shaped cutting blades 940. The padding applicator 910 applies the padding (e.g., foam padding or other padding material that can provide the spring action) around the shaped blade 940 to produce the padded shaped cutting blade 950.

In one implementation, a system 900 for applying padding material around shaped cutting blades 940 is disclosed. The system 900 includes: a bender 930 configured to receive and bend a rule of blade 960 according to a blade shape diagram 920 to produce the shaped cutting blades 940; and a padding applicator 910 configured to receive the blade shape diagram 920 and apply the padding material around the shaped cutting blades 940 using the blade shape diagram 920 to produce a padded shaped cutting blade 950, wherein the padding material provides a spring action to quickly detach the padded shaped cutting blade 950 from a plate matter.

In one implementation, the padding material is foam padding.

In one implementation, a pattern board is configured to receive the shaped cutting blades 940.

In one implementation, the padding applicator 910 is also configured to move above the shaped cutting blades 940 to apply the padding material adjacent to the shaped cutting blades 940.

In one implementation, the padding applicator 910 further includes a sprayer 600 configured to spray the padding material onto the pattern board.

In one implementation, the padding applicator 910 further includes a tube 610 to enable the padding material to be squeezed onto the pattern board.

In one implementation, the system further includes a plurality of nozzles 620 configured to enable the padding material to be applied from the tube 610 at multiple points around the shaped cutting blades. In one implementation, the padding material is applied at multiple points around the shaped cutting blades at the same time. In another implementation, the padding material is applied at multiple points around the shaped cutting blades at different times.

Figure 10:
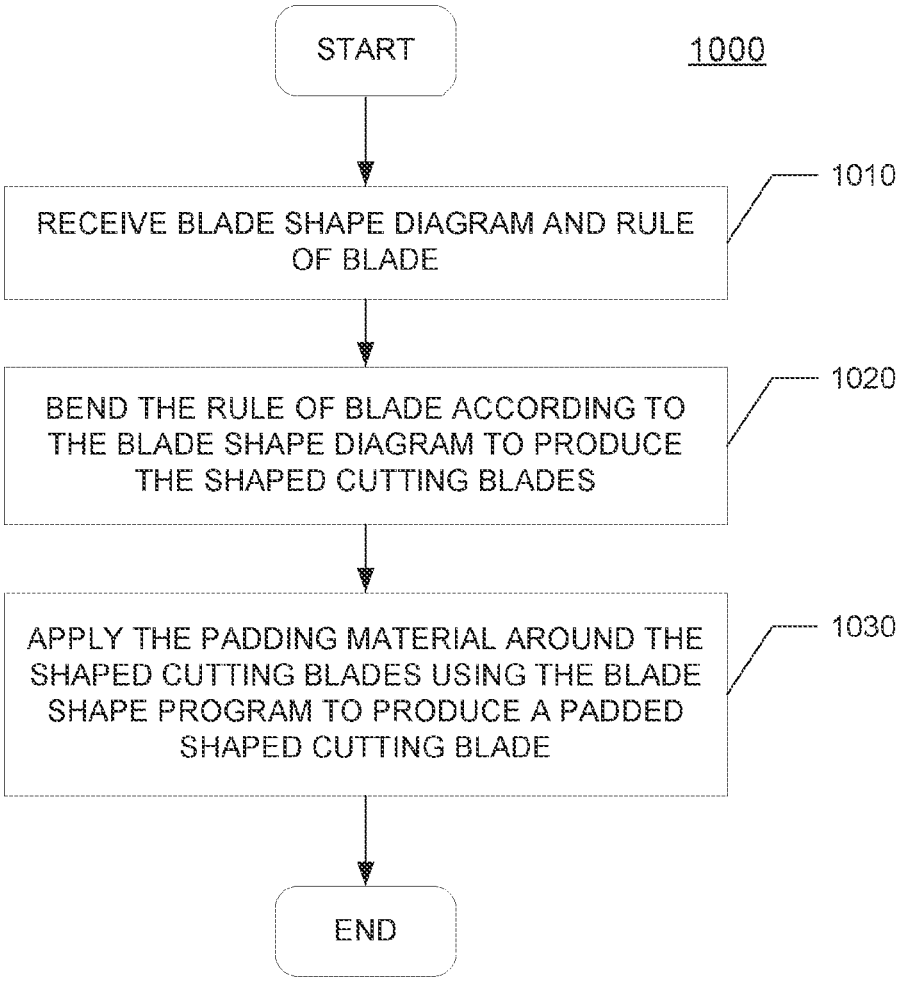
FIG. 10 is a flow diagram of a method for applying padding material around shaped cutting blades in accordance with one implementation of the present disclosure.

FIG. 10 is a flow diagram of a method 1000 for applying padding material around shaped cutting blades in accordance with one implementation of the present disclosure. The method includes receiving a blade shape diagram and a rule of blade, at block 1010. The rule of blade is then bent, at block 1020, according to the blade shape diagram to produce the shaped cutting blades. The padding material is applied around the shaped cutting blades, at block 1030, using the blade shape diagram to produce a padded shaped cutting blade. In one implementation, the padding material provides a spring action to quickly detach the padded shaped cutting blade from a plate matter.

In one implementation, the padding material is foam padding.

In one implementation, the shaped cutting blades are inserted into a pattern board.

In one implementation, applying the padding material around the shaped cutting blades includes moving a padding applicator above the shaped cutting blades inserted into the pattern board; and applying the padding material adjacent to the shaped cutting blades.

In one implementation, applying the padding material adjacent to the shaped cutting blades further includes spraying the padding material onto the pattern board.

In one implementation, applying the padding material adjacent to the shaped cutting blades further includes squeezing the padding material through a nozzle on the padding applicator onto the pattern board.

In one implementation, the method further includes: inserting the shaped cutting blades into a pattern board; and placing the pattern board at a particular position below a padding applicator.

In one implementation, the method further includes moving the padding applicator above the pattern board with respect to the particular position so that the padding material can be applied adjacent to the shaped cutting blades.

In one implementation, the padding applicator includes a plurality of nozzles through which the padding material can be applied adjacent to the shaped cutting blades at multiple points simultaneously.

The above descriptions of the disclosed implementations are provided to enable any person skilled in the art to make or use the disclosure. Various modifications to these implementations will be readily apparent to those skilled in the art, and the generic principles described herein can be applied to other implementations without departing from the spirit or scope of the disclosure. For example, although the examples show the padding material being applied from the top, the padding material can be applied from different directions. Thus, it will be understood that the description and drawings presented herein represent implementations of the disclosure and are therefore representative of the subject matter which is broadly contemplated by the present disclosure. It will be further understood that the scope of the present disclosure fully encompasses other implementations that may become obvious to those skilled in the art and that the scope of the present disclosure is accordingly limited by nothing other than the appended claims.

Accordingly, the foregoing implementations are merely presented as examples and are not to be construed as limiting the present disclosure. The present teachings can be readily applied to other types of apparatus and/or devices. The description of the present disclosure is intended to be illustrative, and not to limit the scope of the claims. Many alternatives, modifications, and variations will be apparent to those skilled in the art.

What is claimed is:

1. A system for applying padding material around shaped cutting blades for a dieboard, the system comprising:

a padding applicator configured to receive a blade shape diagram and apply padding material around a shaped cutting blades using the blade shape diagram to produce a padded shaped cutting blade for the dieboard, wherein the shaped cutting blades is received as an output from a bender which bends an unshaped rule of blade into the shaped cutting blades using the blade shape diagram, wherein the padding applicator applies the padding material around the shaped cutting blades by spraying a foam padding around the shaped cutting blades, wherein the padding applicator is also configured to move above the shaped cutting blades to apply the padding material according to the blade shape diagram adjacent to the shaped cutting blades, wherein the padding material provides a spring action.

2. The system of claim 1, further comprising a pattern board configured to receive the shaped cutting blades.

3. The system of claim 2, wherein the padding applicator further comprises a sprayer configured to spray the padding material onto the pattern board.

4. The system of claim 2, wherein the padding applicator further comprises a tube to enable the padding material to be squeezed onto the pattern board.

5. The system of claim 4, further comprising a plurality of nozzles configured to enable the padding material to be applied from the tube at multiple points around the shaped cutting blades.

* * * * *